US007634837B2

(12) United States Patent
Schluter et al.

(10) Patent No.: US 7,634,837 B2
(45) Date of Patent: Dec. 22, 2009

(54) LIFT-OFF HINGE

(75) Inventors: Robert Schluter, Kinnelton, NJ (US); Richard L. King, Boonton, NJ (US); Leszek Markowski, Riverdale, NJ (US)

(73) Assignee: Middle Atlantic Products, Inc., Fairfield, NJ (US)

( * ) Notice: Subject to any disclaimer, the term of this patent is extended or adjusted under 35 U.S.C. 154(b) by 363 days.

(21) Appl. No.: 11/317,567

(22) Filed: Dec. 23, 2005

(65) Prior Publication Data

US 2007/0143960 A1 Jun. 28, 2007

(51) Int. Cl.
*E05D 7/10* (2006.01)

(52) U.S. Cl. ..... 16/260; 16/254; 16/268; 16/380; 16/386

(58) Field of Classification Search ..... 16/254, 16/260, 268, 380, 386
See application file for complete search history.

(56) References Cited

U.S. PATENT DOCUMENTS

| | | | | | |
|---|---|---|---|---|---|
| 3,766,599 | A * | 10/1973 | Ullman, Jr. | ..... | 16/257 |
| 4,573,239 | A * | 3/1986 | Valenti et al. | ..... | 16/273 |
| 4,827,568 | A * | 5/1989 | Ramsauer | ..... | 16/266 |
| 4,937,916 | A * | 7/1990 | Redman | ..... | 16/243 |
| 5,394,913 | A * | 3/1995 | Zezza et al. | ..... | 150/146 |
| 5,896,622 | A * | 4/1999 | Lu | ..... | 16/342 |
| 5,950,281 | A * | 9/1999 | Lu | ..... | 16/342 |
| 5,987,703 | A * | 11/1999 | Kluting et al. | ..... | 16/262 |
| 6,170,120 | B1 * | 1/2001 | Lu | ..... | 16/342 |
| 6,230,365 | B1 * | 5/2001 | Lu | ..... | 16/342 |
| 6,704,418 | B1 * | 3/2004 | Koshikawa | ..... | 379/433.13 |
| 6,922,872 | B2 * | 8/2005 | Gruber | ..... | 16/260 |
| 7,100,244 | B2 * | 9/2006 | Qin et al. | ..... | 16/330 |
| 7,278,183 | B2 * | 10/2007 | Schluter | ..... | 16/262 |
| 7,281,300 | B2 * | 10/2007 | Andersen et al. | ..... | 16/342 |
| 2004/0025294 | A1 * | 2/2004 | Gruber | ..... | 16/254 |
| 2004/0244147 | A1 * | 12/2004 | Qin et al. | ..... | 16/330 |
| 2005/0077255 | A1 * | 4/2005 | Schluter | ..... | 211/26 |

* cited by examiner

*Primary Examiner*—Victor Batson
*Assistant Examiner*—Roberta Delisle
(74) *Attorney, Agent, or Firm*—Drinker Biddle & Reath LLP

(57) ABSTRACT

An embodiment of a hinge has a first part with a pin, the pin defining a longitudinal axis, and a second part with a receptacle for the pin. The first and second parts are arranged to rotate relative to one another about the axis with the pin in the receptacle. Mutually cooperating formations on the pin and receptacle are arranged to permit separation of the first and second parts along the axis in a first position of relative rotation of the first and second parts and to obstruct separation of the first and second parts along the axis in a second position of relative rotation of the first and second parts.

11 Claims, 7 Drawing Sheets

LIFT-OFF HINGE

FIELD OF THE INVENTION

The present invention relates to hinges and, more particularly, to a lift-off hinge that permits a door or window to be lifted off when open, but hinders lifting off when the door or window is closed.

BACKGROUND

Electrical equipment is commonly installed in enclosures to protect the equipment from accidental/intentional damage, inhibit interference by unqualified and/or unauthorized personnel, and to protect nearby persons from live electrical components of the equipment.

One form of electrical equipment enclosure has a hinged door that can be opened to permit access to equipment within the enclosure or closed to prevent access to equipment within the enclosure. When closed, the door may be secured by a lock at a location remote from the hinge or hinges. In some uses, it is desirable to be able to remove the door from its hinges when the door is open, either to facilitate work on the door or on equipment mounted on the inside of the door, or because in confined areas the open door may obstruct access. However, if the door can be easily removed from its hinges when it is closed, the security provided by the lock may be bypassed.

One form of hinge that has long been popular because of its simple, robust design is a lift-off hinge consisting of a pin that is aligned along a hinge axis and mounted at one end to one of two hinged elements and a loop that fits round the pin and is mounted to the other element. In a common configuration, the pin is upright, and the bottom of the pin is mounted to a doorframe. The loop is then mounted to the door, and the weight of the door holds the loop in position on the pin. Where the door closes within the doorframe, the top of the doorframe may prevent the closed door from being lifted far enough to separate the loop from the pin. However, not all doors and doorframes can readily provide the engagement to prevent lifting off of the closed door.

A need, therefore, has existed until the present invention for a lift-off hinge that permits lifting off when in an open position but that resists lifting off in a closed position.

SUMMARY OF THE INVENTION

One embodiment of the present invention provides a hinge having a first part with a pin, a second part having a receptacle for the pin, the first and second parts arranged to rotate relative to one another about an axis defined by engaging surfaces of the pin and receptacle, and mutually cooperating projections on the pin and receptacle arranged to permit separation of the first and second parts along the axis in a first position of relative rotation of the first and second parts and to obstruct separation of the first and second parts along the axis in a second position of relative rotation of the first and second parts.

BRIEF DESCRIPTION OF THE DRAWINGS

For the purpose of illustrating the invention, there are shown in the drawings one or more forms of the invention that are presently preferred; it being understood, however, that this invention is not limited to the precise arrangements and instrumentalities shown. In the drawings.

DETAILED DESCRIPTION OF THE DRAWINGS

Figure 1:
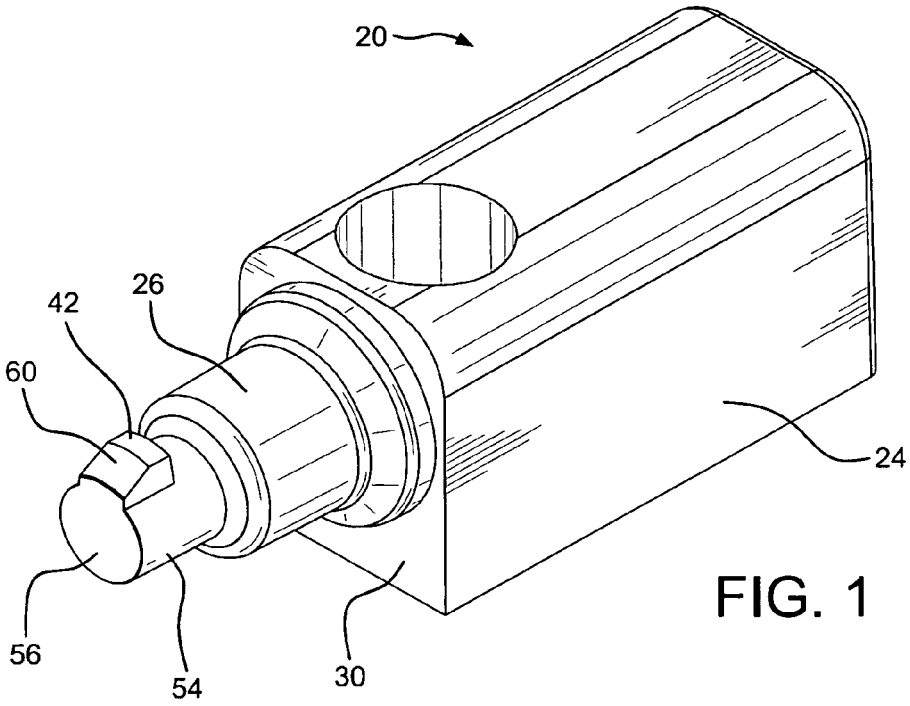
FIG. 1 is a perspective view of a male hinge part in accordance with a first embodiment of the present invention.
Figure 2:
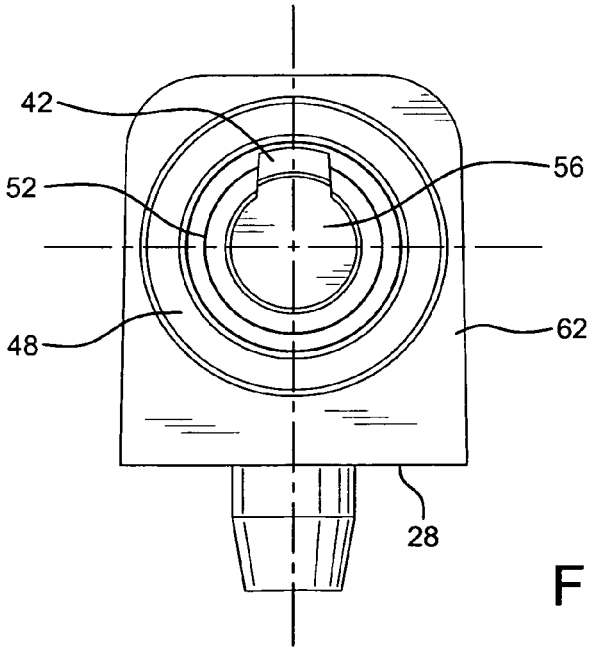
FIG. 2 is an end view of the male hinge part shown in FIG. 1.
Figure 3:
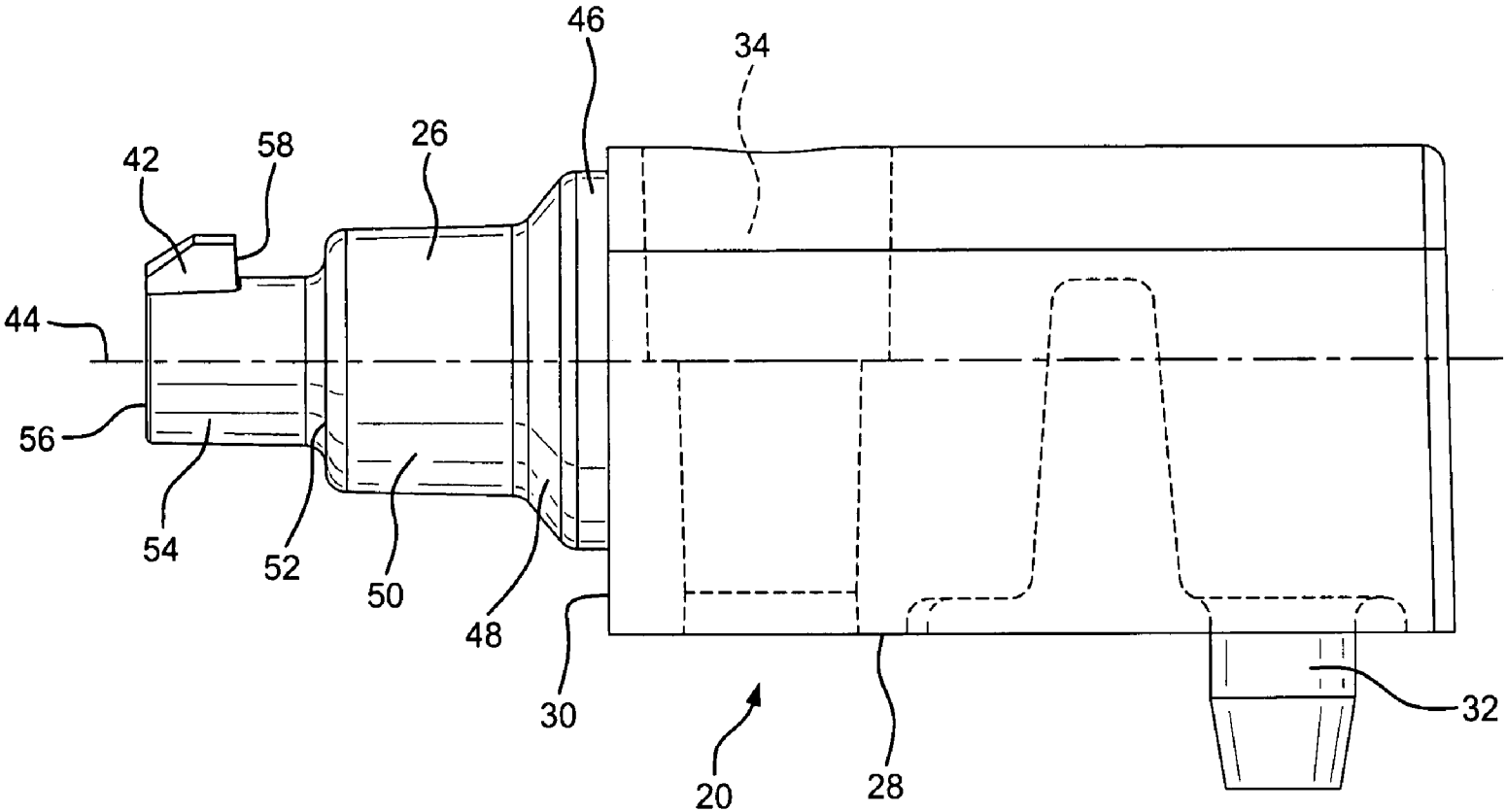
FIG. 3 is a side view of the male hinge part shown in FIG. 1.
Figure 4:
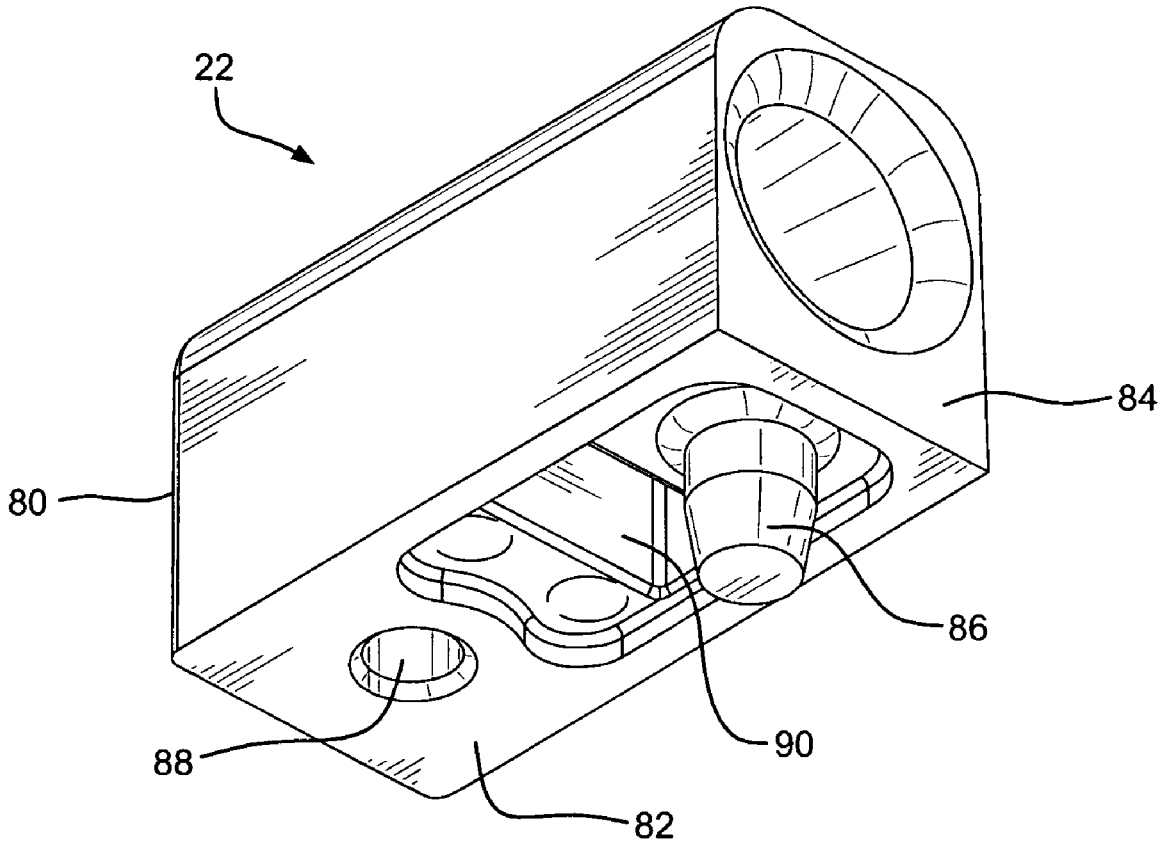
FIG. 4 is a perspective view of a female hinge part in accordance with the first embodiment of the present invention.
Figure 6:
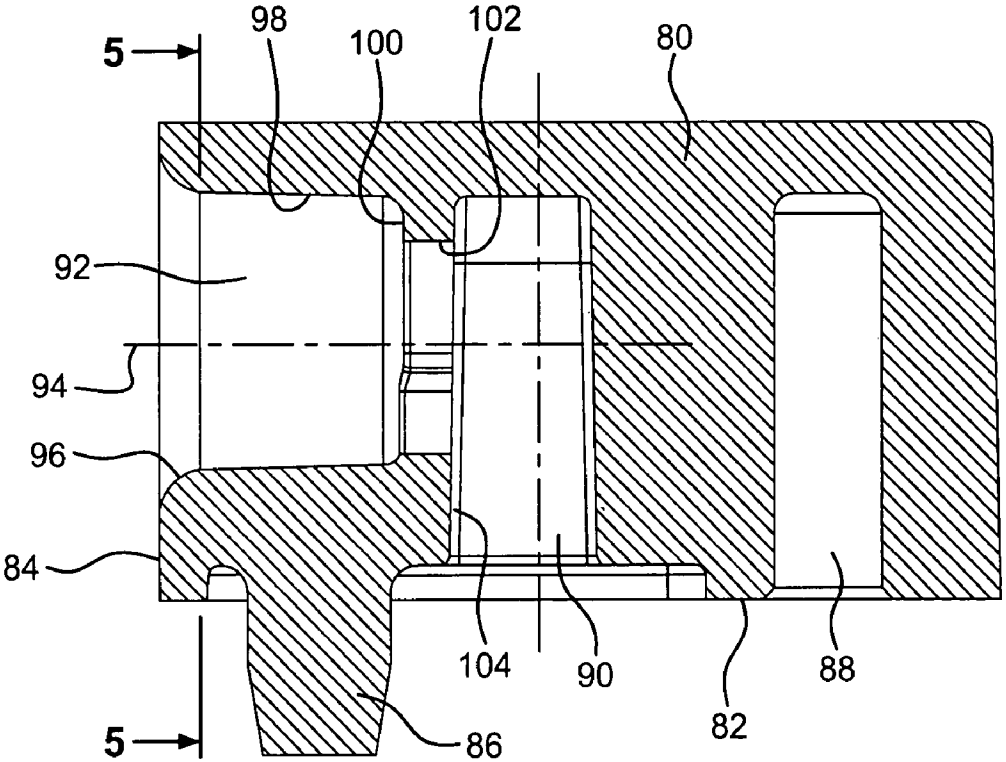
FIG. 6 is side view of the female hinge part shown in FIG. 4.
Figure 5:
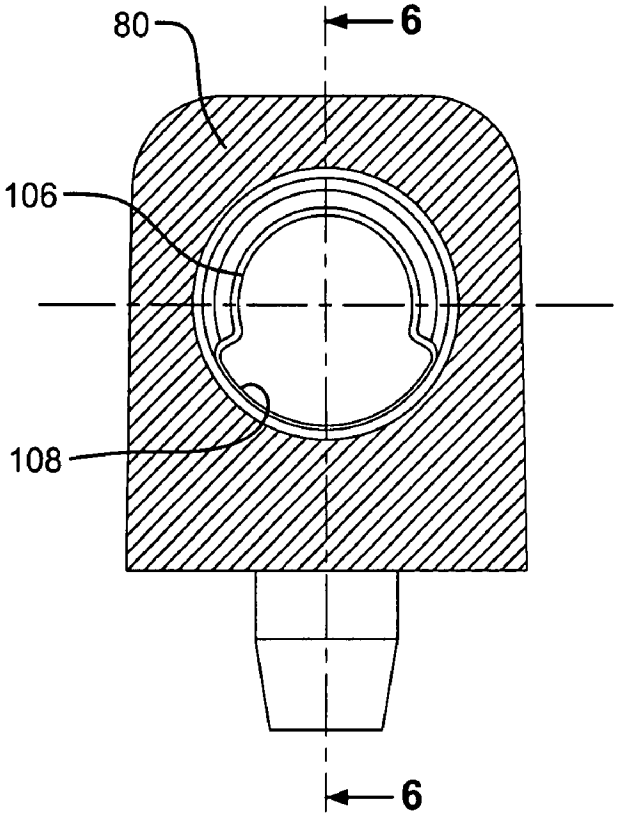
FIG. 5 is a cross sectional view of the female hinge part shown in FIG. 4.

Referring now to the drawings, wherein like reference numerals indicate similar elements throughout the views, a presently preferred embodiment of a hinge comprises a male or first hinge component part, indicated generally by the reference numeral 20 and shown in FIGS. 1 to 3, and a female or second hinge component part, indicated generally by the reference numeral 22 and shown in FIGS. 4 to 6.

Referring especially to FIGS. 1 to 3 which illustrates one exemplary embodiment of the invention, the male part 20 comprises a body 24 and a hinge pin 26. The body 24 has a base 28 and a front face 30 preferably perpendicular to the base. The base 28 defines a surface, preferably flat, for mounting flat against a support surface (not shown) of one of two components that are to be hinged together. The body 24 optionally includes a peg 32 projecting outward from the base 28 that may fit into a hole in the support surface. The body 24 may include a counterbore 34 to receive a screw to fasten the hinge part 20 to the support surface. Other forms of attachment may be provided instead of, or addition to, the peg 32 and the bore 34. As shown in FIG. 3, a recess 36 is formed in the base 28, surrounding the peg 32. The recess 36 allows any flash left from knock-out pins to be inside the plane of the base 28, and allows the peg 32 to be radiused where it joins the body 24, without the flash or radiusing projecting outside the plane of the base 28 and interfering with mounting of the hinge part 20 on a flat surface.

The outside contour of the body 24 may be of a variety of shapes. As shown in the embodiment of FIG. 1, the body 24 may be generally cuboidal with rounded edges and a slight draft to allow easy demolding when the hinge part 20 is cast.

Projecting from the front face 30 is the hinge pin 26 which, apart from a beak 42 described in more detail below, is preferably symmetrical about an axis 44 parallel to the base 28 and perpendicular to the front face 30.

Starting from front face 30, the hinge pin 26, in the exemplary embodiment illustrated, has a first drum portion 46, followed by a shoulder forming a first bearing surface 48, followed by a second drum portion 50, followed by a shoulder forming a second bearing surface 52, ending with a tip 54 in the form of a third drum portion. The tip 54 terminates in an end face 56 forming a free end of the hinge pin 26. The drum portions 46, 50, 54 are approximately cylindrical, but need not be exact cylinders. In particular, if the hinge parts 20, 22 are cast or molded the drum parts may have a few degrees of taper or draft for easier demolding. The separations between successive surfaces of the hinge pin 26 may be rounded. As shown in FIGS. 1 to 3, the first bearing surface 48 is generally conical, with small rounded transitions to the adjacent drum portions 46, 50, and the second bearing surface 52 is formed primarily by two rounded transitions preferably with no, or only a minimal, straight section between them. Any convenient proportion of straight to rounded surface may be used for either or both of the bearing surfaces 48, 52 and may be at any suitable angle to the axis 44.

The beak 42 or projection extends laterally from the tip 54 for part of the length of the tip. The beak 42 has a locking face or ledge 58 on the side of the beak 42 that faces towards the body 24. The locking face 58 is preferably approximately perpendicular to the axis 44 and is located so as to define a space between the locking face 58 and the second bearing surface 52. The part of the beak 42 nearer the end face 56 has a beveled or tapered surface 60.

The hinge part 20 can be formed in a simple two-part mold, with the two mold parts parting in a direction perpendicular to the base 28. Other mold configurations, and methods of forming the hinge part 20 other than molding, are also possible.

Referring now to FIGS. 4 to 6 which illustrates one exemplary embodiment of the second or female hinge component according to the present invention, the female hinge part 22 has a body 80 that may be similar in configuration to the body 24 of the male hinge part 20. The body 80 has a base 82 and a front face 84 preferably generally perpendicular to the base 82. The base 82 of the female body part 22 is similar to the base 28 of the male body part 20, but is preferably oriented so that a peg 86, corresponding to the peg 32, is at the end nearer the front face 84, and a bore 88 corresponding to the stepped bore 34 is at the end further from the front face. Between the peg 86 and the bore 88 is a slot 90. The slot 90 preferably extends over most of the cross section of the body 80, leaving sufficient wall thickness for structural integrity on all sides except through the base 82.

A bore 92 forming a receptacle for the hinge pin 26 extends through the front face 84. The bore 92 is largely symmetrical about an axis 94 that is preferably substantially perpendicular to the front face 84 and parallel to the base 82. The distance from the base 82 to the axis 94 is substantially equal to the distance from the base 28 to the axis 44 of the male part 20 for situations where the components being hinged have mounting surfaces that lie along the same plane. The bore 92 preferably has, in order from the front face 84, a rounded transition surface 96, a drum portion or barrel section 98, a shoulder 100, and a neck 102, beyond which the bore 92 opens out into the slot 90 at a wall 104. The inside diameter of the barrel 98 is equal or slightly larger than the outside diameter of the second drum portion 50 of the hinge pin 26, and the distance between the transition surface 96 and the shoulder 100 corresponds to the distance between the bearing portions 48 and 52 of the hinge pin 26.

As is best seen in FIG. 5, the neck 102 is not symmetrical about the axis 94, but is largely defined by two arcs 106, 108, each centered on the axis 98, which together encompass the circumference of the neck. The inner arc 106, which as shown in FIG. 5 is the major arc of the circumference, has a radius slightly greater than that of the tip 54 of the hinge pin 26. The inner arc 106 is formed by an arcuate rib projecting radially inward from the curve of the outer arc 108 from the wall of the bore 92, which rib also forms a large part of the shoulder 100 and the operative part of the wall 104. The outer arc 108 has a radius greater than the distance from the axis 44 to the tip of the beak 42, and bounds a gap between the ends of the arcuate rib. The outer arc 108 is longer circumferentially than the circumferential width of the beak 42.

As will be discussed in more detail below, the outer arc 108 extends over about 90° of arc around the axis 94.

The female hinge part 22 may be molded using a three-part mold. Two of the mold parts are very similar to those used for the male hinge part 20, but without the hinge pin 26. The third mold part enters and parts along the axis 94 and forms the bore 92 up to and including the neck 102. The wall 104 and the slot 90 beyond it are formed by a projection of the mold part that forms the base 82. Other mold configurations, and methods of forming the hinge part 22 other than molding, are also possible.

The hinge pin 26 and the bore 92 are matched so that if the hinge pin 26 is inserted in the bore 92 they can rotate without binding and without unnecessary play. The second drum portion 50 and the barrel 98 cooperate to form a rotational plain bearing. The inner arc 106 of the neck 102 and the part of the tip 54 between the beak 60 and the second bearing surface 52 cooperate to form a rotational plain bearing. The first bearing surface 48 and the transition surface 96 at one end and the second bearing surface 52 and the shoulder 100 at the other end cooperate to form two plain thrust bearings. The male part 20 and the female part 22 can thus rotate relative to one another about the coincident axes 44, 94 while supporting an axial force tending to urge them together. The length of the neck 102 is selected so that when the thrust bearings 48, 96 and 52, 100 are engaged, the beak 42 is inside the slot 90 with the locking face 58 of the beak overlying the wall 104 of the slot 90 that surrounds the neck 102 closely, but without binding.

The hinge pin 26 can be freely inserted into the bore 92 when the beak 42 is aligned with the outer arc 108. The male hinge part 20 and the female hinge part 22 can then be rotated relative to one another, and when the beak 42 aligns with the inner arc 106 the engagement of the locking face 58 of the beak with the wall 104 prevents the hinge parts 20, 22 being separated without damaging the hinge.

In use, the hinge parts 20, 22 are attached to two components that are to be hinged to one another, with the bases 28, 82 of the hinge parts flat against surfaces of the components. The pegs 32, 86 may be inserted into holes provided in the components to provide alignment, and screws may be inserted in the bores 34, 88 to secure the hinge parts to the components. In one use, one of the hinge parts, usually the male hinge part 20, is attached to a door frame, and the other hinge part is attached to an associated door. The hinge parts 20, 22 are positioned with the axes 44, 94 upright, and the lower hinge part attached to the door frame, so that the weight of the door tends to hold the thrust bearings 48, 96 and 52, 102 engaged and the thrust bearings support the weight of the door. A door typically has two or more hinges. Both or all of the hinges may then be hinges comprising hinge parts 20, 22. Alternatively, only one, or fewer than all, of the hinges may comprise hinge parts 20, 22 and the remaining hinge or hinges may be conventional lift-off hinges.

The hinge parts 20, 22 are aligned so that when the door is closed the beak 42 overhangs the inner arc 106 of the neck 102, preventing the door being lifted off. However, the hinge parts 20, 22 are also aligned so that the door can be opened to a position where the beak 42 aligns with the outer arc 108 of the neck 102, allowing the hinge parts to be separated and the door to be lifted off its hinges. Similarly, the door can be lowered onto its hinges in the open position. The beveled surface 60 on the beak 42 assists in insertion of the hinge pin 26 into the bore 92. The door can then be rotated into the closed position, in which it cannot be lifted off.

In the hinge male part 20 shown in FIGS. 1 to 3 and the hinge female part 22 shown in FIGS. 4 to 6, the beak 42 projects away from the base 28 of the male hinge part 20, and the outer arc 108 of the neck 102 occupies about ¼or ⅓of the circumference of the neck on the side nearest the base 82 of the female hinge part 22. Thus, the hinge parts 20, 22 are most securely held together when the bases 28, 82 are on the same side of the hinge axis 44, 94. The hinge may be lifted off or brought together axially over an arc of about 90° to 120° centered on a position in which the bases 28 and 82 are on opposite sides of the axis 44, 94.

The alignment of the secure and lift-off positions may be different. For ease of molding the beak 42 in the embodiment shown in FIGS. 1 to 3, the beak preferably points either towards or away from the base 28, but the orientation of the inner and outer arcs of the neck 102 in the embodiment shown in FIGS. 4 to 6 may easily be changed, essentially merely by rotating the mold part forming the bore 92. For use as a security door hinge, the hinge parts 20, 22 may be configured so that the hinge is secure when the door is closed, and can be lifted off when the door is open about 90°. For example, the hinge parts 20, 22 may be configured so that the hinge can be lifted off when the door is between about 45° and about 135° from the closed position.

The proportion of orientations in which the hinge is secured against lifting off may be changed by changing the relative lengths of the inner arc 106 and the outer arc 108. The outer arc 108 may be longer than the inner arc 106. To allow for two (or more) distinct lift-off orientations and/or two (or more) distinct secure orientations of the hinge, the neck 102 may have two (or more) inner arcs 106 separated by outer arcs 108. For example, the neck 102 may have two outer arcs 108 approximately opposite one another, so that the hinge can be lifted off at approximately 90° from the closed position on either side of the closed position. In some cases, this may save manufacturing and stocking distinct left- and right-handed hinge parts.

In the closed position, the first drum section 46 of the hinge pin 26 acts as a spacer, defining a clearance between the front faces 30, 84 of the hinge parts 20, 22. The first drum section 46 is the widest part of the hinge pin 26, which discourages any attempt to saw through it.

Figure 7:
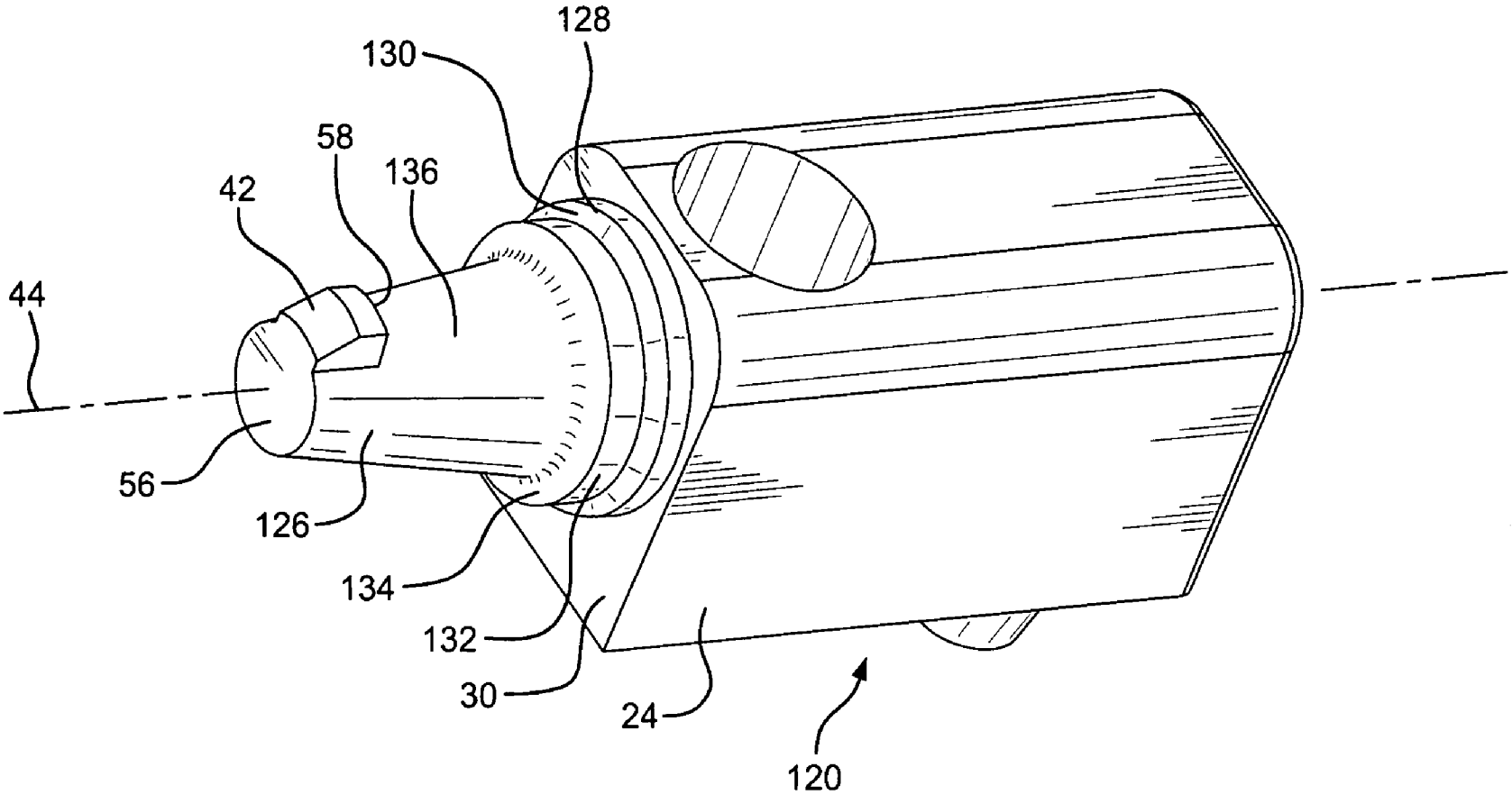
FIG. 7 is a perspective view of a male hinge part in accordance with a second embodiment of the present invention.
Figure 8:
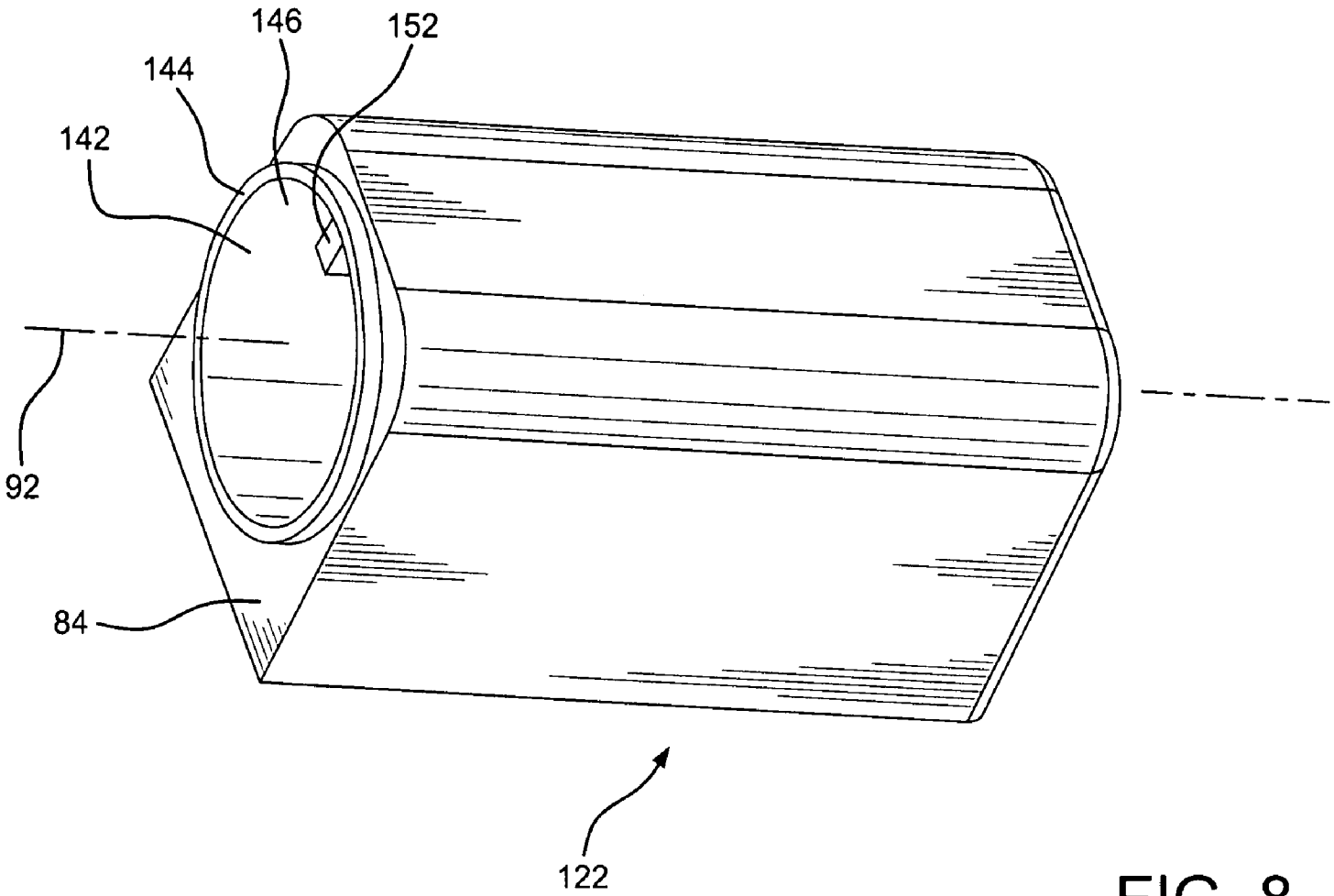
FIG. 8 is a perspective view of a female hinge part in accordance with the second embodiment of the present invention.

Referring now to FIGS. 7 and 8, a second form of hinge male part 120 and hinge female part 122 may be generally similar to the hinge male part 20 and hinge female part 22 shown in FIGS. 1 to 6 except as described below. Reference is made to the description of FIGS. 1 to 6, which is not unnecessarily repeated, features that are substantially similar to those shown in FIGS. 1 to 6 being identified by the same reference numerals, Referring initially to FIG. 7, in the second form of hinge male part 120, the hinge pin 126 preferably has, starting from front face 30 of body 24, a collar 128 forming a first bearing surface 130, a first drum portion 132, followed by a shoulder forming a second bearing surface 134, followed by a frustoconical second drum portion 136 that terminates in an end face 56 forming a free end of the hinge pin 126. The collar 128 and the first drum portion 132 are approximately cylindrical, but need not be exact cylinders. In particular, if the hinge parts 20, 22 are cast or molded the drum parts may have a few degrees of taper or draft for easier demolding. The separations between successive surfaces of the hinge pin 126 may be rounded. Any convenient proportion of straight to rounded surface may be used for either or both of the bearing surfaces 130, 134 and may be at any suitable angle to the axis 44.

The beak 42 or projection extends laterally from the second drum portion 136 preferably adjacent to the end face 56.

Figure 8A:
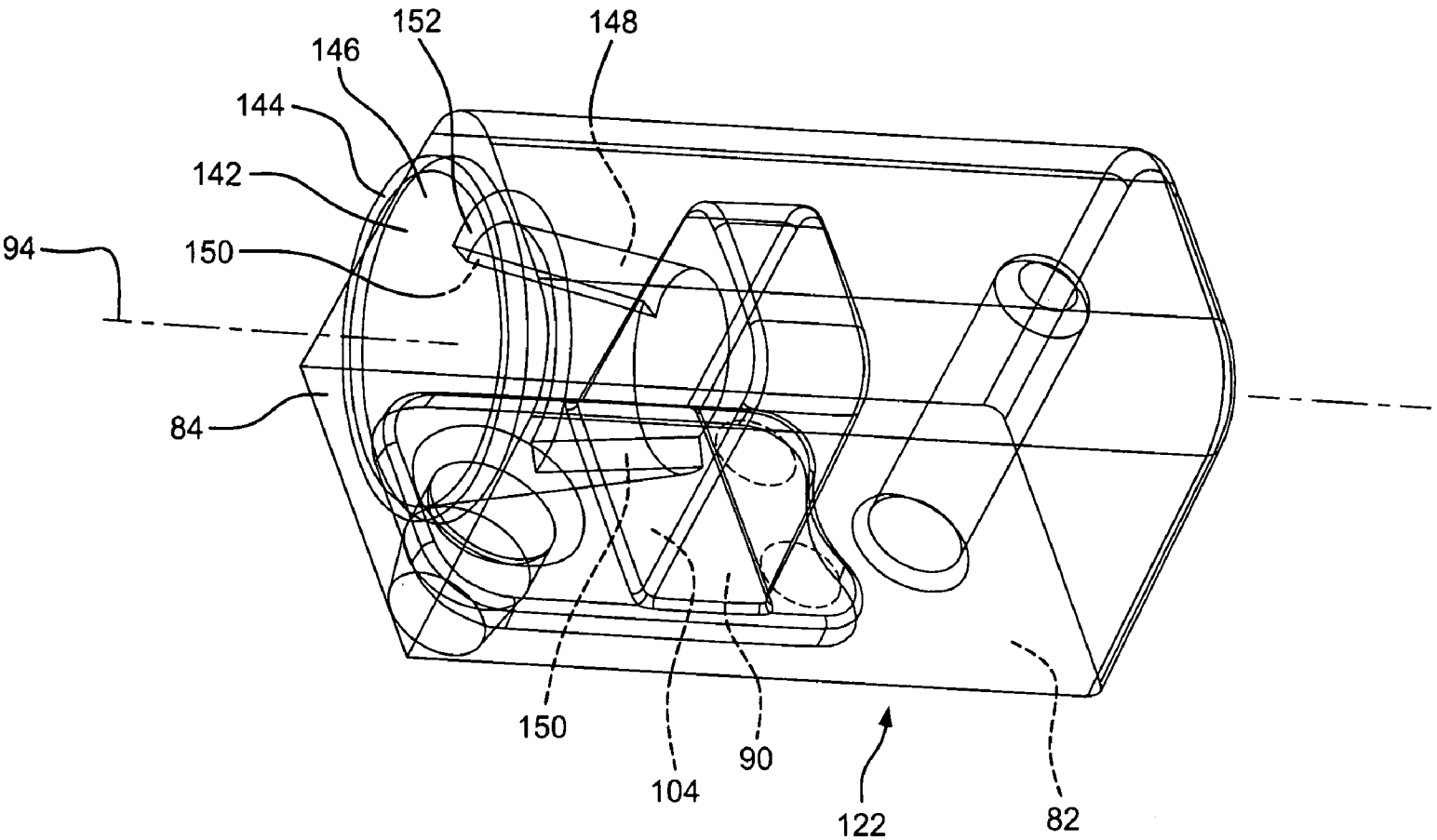
FIG. 8A is a perspective wire frame view of the female hinge part in FIG. 8.

Referring now to FIGS. 8 and 8A, which illustrate, respectively, a solid view and a wire frame view of the female hinge part 122, a bore 142 forming a receptacle for the hinge pin 126 extends through the front face 84 of the body 80. The bore 142 has a flange 144 projecting from the front face 84 with the inner face of the flange 144 forming the beginning of a frustoconical internal wall 146 of the bore 142. The frustoconical internal wall 146 is centered on an axis 94 of the bore 142, and narrows away from the flange 144 until the bore 142 opens into a slot 90 extending in from the base 82. For part of the length of the bore 142, extending to the slot 90, the bore 142 includes, over part of its circumference, a narrower wall 148. The wall 148, like the wall 146, is preferably frustoconical and centered on the axis 94. The walls 146, 148 are separated by two axial and radial facets 150 and a circumferential and radial facet 152. The part of the female hinge part 122 bounded by the facets 150, 152 and the wall 104 of the slot 90 thus forms an arcuate rib similar in function, though more massive and stronger in construction, to the rib defining the inner arc 106 in FIGS. 4 to 6.

When the hinge pin 126 is fully inserted, the narrower internal wall 148 is as large as or slightly larger than the adjacent part of the second drum portion 136 of the hinge pin 126, and the first drum portion 132 is the same size as or slightly smaller than the adjacent part of the wider frustoconical wall 148. The distance between the flange 144 and the facet 152 corresponds to the distance between the bearing portions 130 and 134 of the hinge pin 126. The distance between the flange 144 and the nearer face 104 of the slot 90 corresponds to the distance between the bearing portions 130 of the hinge pin 126 and the underhang 58 of the beak 42.

When the hinge pin 126 is fully inserted into the bore 142, the flange 144 rides on the first bearing surface 130 of the collar 128 of the hinge pin 126, and the second bearing surface 134 rides on the circumferential and radial facet 152 at the outer end of the narrower internal wall 148, cooperating to form two plain thrust bearings. The first drum portion 132 and the wider frustoconical wall 148 cooperate to form a rotational plain bearing.

Preferably the hinge pin 126 and the bore 142 are matched so that if the hinge pin 26 is inserted in the bore 142 they can rotate without binding and without unnecessary play. The male part 120 and the female part 122 can thus rotate relative to one another about the coincident axes 44, 94 while supporting an axial force tending to urge them together.

The hinge pin 126 can be freely inserted into the bore 142 when the beak 42 is aligned with the gap between the facets 150 on the side away from the narrower frustoconical wall 148. The male hinge part 20 and the female hinge part 22 can then be rotated relative to one another, and when the beak 42 aligns with the narrower wall 148 the engagement of the locking face 58 of the beak with the wall 104 of the slot 90 prevents the hinge parts 120, 122 being separated without damaging the hinge.

The hinge parts 120, 122 may be used similarly to the hinge parts 20, 22 described above.

The arc length and alignment of the beak 42 shown in FIG. 7 and the narrower wall 148 shown in FIG. 8 may be selected and varied similarly to the beak 42 and the inner arc 106 shown in FIGS. 1 to 6.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

Although the hinge parts 20, 22 and 120, 122 have been shown with identical pegs 32, 86 and different bores 34, 88, other forms of attachment and location device may be provided. It is preferred that any hole for a screw or bolt passing through female hinge part 22, 122 be at the end further from the front face 84, to avoid the bolt or screw obstructing the bore 92, 142. Any screw or bolt intended to be inserted in the open-topped bore 34 may have a security head to prevent its being easily unscrewed.

The body 24 of the male hinge part 20, 120 and the body 80 of the female hinge part 22, 122 have been shown as nearly identical. This may be preferred, both for ease of manufacture and for esthetic reasons. However, the body parts 24, 80 may instead be of different shapes.

In FIGS. 4 to 6 and 8, the slot 90, including the wall 104, is formed by molding in the form of a slot open only through the base 82, which is arranged in use to be flat against a surface of one of the components being hinged together. Thus, in use the beak 42 and the arcuate rib cooperating with the beak are comparatively inaccessible. Other arrangements are possible, but it may be preferred to arrange the female hinge part 22, 122 so that with the hinge in the closed, secure position the beak 42 is neither visible nor accessible.

As has been noted above in specific instances, any surface may depart by a few degrees of draft from its notional orientation, for ease of molding. However, it will usually be easiest for the assembler if the hinge pin axis 44 and the bore axis 94 are parallel to the respective bases 28, 82.

Also, while the use of the hinge has been described with reference to a door attached to its frame by upright hinges, it is also contemplated that the present invention can be used as a horizontal hinge, or a hinge at any other angle, or a hinge on a movable object that has no well-defined orientation. Thus, orientational terms are intended to describe the illustrated embodiment and, therefore, should only be considered exemplary.

Accordingly, reference should be made to the appended claims, rather than to the foregoing specification, as indicating the scope of the invention.

What is claimed is:

1. A hinge comprising:

a pin part comprising a body;

a pin extending from the body to a free end, the pin defining a longitudinal axis, the pin generally rotationally symmetrical about the axis; and a beak projecting from the pin in a direction radially away from the axis and spaced apart from the body; and a receptacle part comprising:

a body defining a central hole, wherein the pin can seat within the hole rotatably about the axis; and a rib partly encircling the hole and projecting radially inwards into the hole and having a gap between its ends, so that when the beak is aligned with the gap the pin can be inserted into or removed from the hole with the beak passing through the gap, and when the beak is not aligned with the gap the rib and the beak interfere to prevent the pin from being inserted into or removed from the hole;

wherein the pin part is freely rotatable relative to the receptacle part with the pin seated in the hole and the beak on the opposite side of the rib from the pin part; and wherein the pin part has a mounting surface on one side of the pin, the receptacle part has a mounting surface on one side of the hole, and when the beak is aligned with the gap the mounting surfaces are on opposite sides of the pin and hole.

2. A hinge according to claim 1, wherein the pin part and the receptacle part have respective mounting pegs projecting from the mounting surfaces.

3. A hinge comprising:

a pin part comprising a body;

a pin extending from the body to a free end, the pin defining a longitudinal axis, the pin generally rotationally symmetrical about the axis; and a beak projecting from the pin in a direction radially away from the axis and spaced apart from the body; and a receptacle part comprising:

a body defining a central hole, wherein the pin can seat within the hole rotatably about the axis; and a rib partly encircling the hole and projecting radially inwards into the hole and having a gap between its ends, so that when the beak is aligned with the gap the pin can be inserted into or removed from the hole with the beak passing through the gap, and when the beak is not aligned with the gap the rib and the beak interfere to prevent the pin from being inserted into or removed from the hole;

wherein the pin part is freely rotatable relative to the receptacle part with the pin seated in the hole and the beak on the opposite side of the rib from the pin part body;

wherein the hinge part has a bore for a fastener extending through the body across the axis of the pin.

4. A hinge comprising:

a pin part comprising a body;

a pin extending from the body to a free end, the pin defining a longitudinal axis, the pin generally rotationally symmetrical about the axis; and a beak projecting from the pin in a direction radially away from the axis and spaced apart from the body; and a receptacle part comprising:

a body defining a central hole, wherein the pin can seat within the hole rotatably about the axis; and a rib partly encircling the hole and projecting radially inwards into the hole and having a gap between its ends, so that when the beak is aligned with the gap the pin can be inserted into or removed from the hole with the beak passing through the gap, and when the beak is not aligned with the gap the rib and the beak interfere to prevent the pin from being inserted into or removed from the hole;

wherein the pin part is freely rotatable relative to the receptacle part with the pin seated in the hole and the beak on the opposite side of the rib from the pin part body;

wherein the hole does not extend the whole length of the receptacle part, and the receptacle part has a bore for a fastener extending through the body across the axis of the pin.

5. A hinge comprising:

a pin part comprising a body;

a pin extending from the body to a free end, the pin defining a longitudinal axis, the pin generally rotationally symmetrical about the axis; and a beak projecting from the pin in a direction radially away from the axis and spaced apart from the body; and a receptacle part comprising:

a body defining a central hole, wherein the pin can seat within the hole rotatably about the axis: and a rib partly encircling the hole and projecting radially inwards into the hole and having a gap between its ends, so that when the beak is aligned with the gap the pin can be inserted into or removed from the hole with the beak passing through the gap, and when the beak is not aligned with the gap the rib and the beak interfere to prevent the pin from being inserted into or removed from the hole;

wherein the pin part is freely rotatable relative to the receptacle part with the pin seated in the hole and the beak on the opposite side of the rib from the pin part body;

wherein the receptacle body has a recess extending into it from one side, the hole extends from an end of the receptacle body to the recess, and when the pin is seated in the hole the beak is in the recess.

6. A hinge according to claim 1, wherein the beak is adjacent a free end of the pin.

7. A hinge according claim 1, wherein the beak has a beveled surface facing towards a free end of the pin.

8. A hinge according to claim 1, wherein the rib on the receptacle comprises an arcuate shoulder centered on the axis.

9. A hinge according to claim 1, wherein the rib on the receptacle defines a radially inward facing surface encircling the axis over a major arc that with the pin seated in the receptacle cooperates with the pin to form a rotational bearing.

10. A hinge according to claim 1, wherein the pin and receptacle are narrower at a free end of the pin than at a mouth of the receptacle, and have at least one shoulder on the pin and at least one shoulder on the receptacle that when the pin is in the receptacle cooperate as a thrust bearing.

11. A hinge according to claim 8, wherein the pin and receptacle comprise at least two shoulders separated by a drum portion that, when the shoulders are in cooperating engagement, acts as a plain rotational bearing.

* * * * *

UNITED STATES PATENT AND TRADEMARK OFFICE

CERTIFICATE OF CORRECTION

PATENT NO. : 7,634,837 B2
APPLICATION NO. : 11/317567
DATED : December 22, 2009
INVENTOR(S) : Schluter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 419 days.

Signed and Sealed this

Ninth Day of November, 2010

David J. Kappos

David J. Kappos
*Director of the United States Patent and Trademark Office*